US010107279B2

(12) United States Patent
Dankbaar et al.

(10) Patent No.: US 10,107,279 B2
(45) Date of Patent: Oct. 23, 2018

(54) UNITARY FLUID FLOW APPARATUS FOR INFLATING AND DEFLATING A DEVICE

(71) Applicant: Kongsberg Automotive AB, Mullsjö (SE)

(72) Inventors: Frank Dankbaar, Mullsjö (SE); Anders Grönhage, Mullsjö (SE)

(73) Assignee: KONGSBERG AUTOMOTIVE AB, Mullsjö (SE)

( * ) Notice: Subject to any disclaimer, the term of this patent is extended or adjusted under 35 U.S.C. 154(b) by 327 days.

(21) Appl. No.: 14/651,168

(22) PCT Filed: Dec. 10, 2012

(86) PCT No.: PCT/IB2012/002647
§ 371 (c)(1),
(2) Date: Jun. 10, 2015

(87) PCT Pub. No.: WO2014/091266
PCT Pub. Date: Jun. 19, 2014

(65) Prior Publication Data

US 2015/0316045 A1 Nov. 5, 2015

(51) Int. Cl.
*F04B 43/04* (2006.01)
*F04B 49/02* (2006.01)
(Continued)

(52) U.S. Cl.
CPC ..... *F04B 43/04* (2013.01); *F04B 1/14* (2013.01); *F04B 1/146* (2013.01); *F04B 27/04* (2013.01);
(Continued)

(58) Field of Classification Search
None
See application file for complete search history.

(56) References Cited

U.S. PATENT DOCUMENTS 3,856,438 A * 12/1974 Simko ..... F02D 1/00 123/364
3,856,483 A 12/1974 Rumpf et al.
(Continued)

FOREIGN PATENT DOCUMENTS

DE 10 99 357 B 2/1961
DE 2 362 526 A1 6/1974
(Continued)

OTHER PUBLICATIONS

Machine-assisted English language translation for Application No. DE 10 99 357 extracted from espacenet.com database on Jun. 10, 2015, 5 pages.
(Continued)

*Primary Examiner* — Peter J Bertheaud
*Assistant Examiner* — Geoffrey Lee
(74) *Attorney, Agent, or Firm* — Howard & Howard Attorneys PLLC

(57) ABSTRACT

The subject invention provides a fluid flow apparatus for transporting a fluid to inflate and deflate a device including a pumping device and a housing defining a chamber, an inlet port, a fill port, and an exhaust port. A seal member is movable between a seated position closing the exhaust port and an unseated position. A motor has a shaft rotating in each of a first and second rotational direction. A clutch is disengaged from the shaft as the shaft rotates in the first rotational direction and is engaged with and rotates with the shaft as the shaft rotates in the second rotational direction. A centrifugal member is mounted and rotates with the clutch when the shaft rotates in the second rotational direction and engages the seal member to move the seal member to the unseated position for permitting the fluid within the chamber to escape through the exhaust port.

19 Claims, 11 Drawing Sheets

(51) Int. Cl.

| | |
|---|---|
| ***F04B 1/14*** | (2006.01) |
| ***F04B 27/04*** | (2006.01) |
| ***F04B 27/10*** | (2006.01) |
| ***F04B 49/00*** | (2006.01) |

(52) U.S. Cl.
CPC ..... *F04B 27/10* (2013.01); *F04B 27/1054* (2013.01); *F04B 49/007* (2013.01); *F04B 49/02* (2013.01)

(56) References Cited

U.S. PATENT DOCUMENTS

| | | | | |
|---|---|---|---|---|
| 3,973,471 | A | 8/1976 | Hirmann | |
| 4,486,152 | A | 12/1984 | Porel | |
| 4,990,066 | A | 2/1991 | Kern | |
| 5,224,848 | A | 7/1993 | Noburu et al. | |
| 5,334,130 | A | 8/1994 | Glater et al. | |
| 5,398,713 | A | 3/1995 | Whitman | |
| 7,331,773 | B2 * | 2/2008 | Nawa | A61B 5/02141 417/12 |
| 7,377,756 | B2 * | 5/2008 | Hori | F04B 45/043 417/413.1 |
| 7,527,595 | B2 | 5/2009 | Hori | |
| 9,951,769 | B2 * | 4/2018 | Fukami | F04B 53/1072 |
| 2001/0014288 | A1 | 8/2001 | Lynn et al. | |
| 2005/0047934 | A1 * | 3/2005 | Nawa | A61B 5/02141 417/357 |
| 2005/0047940 | A1 * | 3/2005 | Nawa | A61B 5/02141 417/413.1 |
| 2005/0163634 | A1 * | 7/2005 | Hori | F04B 45/043 417/413.1 |
| 2011/0229359 | A1 | 9/2011 | Dörfler et al. | |
| 2011/0282223 | A1 | 11/2011 | Sano et al. | |
| 2014/0099222 | A1 * | 4/2014 | Yu | F04B 43/026 417/437 |
| 2014/0170005 | A1 * | 6/2014 | Yajima | F04B 11/005 417/539 |
| 2014/0255230 | A1 * | 9/2014 | Chang | F04B 43/04 417/480 |
| 2016/0047375 | A1 * | 2/2016 | Fukami | F04B 45/04 417/472 |

FOREIGN PATENT DOCUMENTS

| | | | |
|---|---|---|---|
| EP | 0 180 510 | A | 5/1986 |
| WO | WO 2004 106735 | A1 | 12/2004 |

OTHER PUBLICATIONS

English language abstract and machine-assisted English language translation for Application No. EP 0 180 510 extracted from espacenet.com database on Jun. 10, 2015, 5 pages.

English language abstract and machine-assisted English language translation for Application No. WO 2004/106735 extracted from espacenet.com database on Jun. 10, 2015, 13 pages.

International Search Report for PCT Application No. PCT/IB2012/002647 dated Sep. 29, 2013, 4 pages.

* cited by examiner

UNITARY FLUID FLOW APPARATUS FOR INFLATING AND DEFLATING A DEVICE

RELATED APPLICATIONS

This application is the National Stage of International Patent Application No. PCT/IB2012/002647, filed Dec. 10, 2012, the entire contents of which are hereby incorporated by reference.

BACKGROUND OF THE INVENTION

1. Field of the Invention

A fluid flow apparatus for or transporting a fluid to inflate and deflate a device. In particular, the subject invention relates to a unique design of a shaft rotating in a first rotation direction to inflate the device and rotating in a second rotational direction to deflate the device.

2. Description of Related Art

There is a desire within the automotive industry to provide adjustable support to a vehicle seat. A popular method of adjusting the support of a vehicle seat is through inflatable bladders disposed within a seat. A pump supplies a fluid to the bladders to inflate and deflate the bladders which adjusts the support of the seat. Many techniques have been used to inflate and deflate the bladders. One solution in the industry involves a diaphragm pump fluidly coupled to the bladders with the diaphragm pump transporting the fluid to the bladders to inflate the bladders. An electronic valve is fluidly coupled to the bladder. The electronic valve exhausts air from the bladders to the atmosphere to deflate the bladders. Although effective, the inflating and deflating of the bladders requires two devices (i.e. the diaphragm pump and the electronic valve) to complete the required inflating and deflating of the bladders. Each of the diaphragm pump and the electronic valve require space within the vehicle, which the vehicle has a limited amount of. The diaphragm pump and the electronic valve can require different controls in order to distinctly operate each device. Furthermore, the diaphragm pump and the electronic device collectively add additional weight which has an adverse effect on fuel economy.

Therefore, there remains an opportunity to develop a fluid flow apparatus capable of both inflating and deflating a device.

SUMMARY OF THE INVENTION AND ADVANTAGES

The subject invention provides for a fluid flow apparatus for transporting a fluid to inflate and deflate a device including a housing defining a chamber. The housing further defines an inlet port, a fill port, and an exhaust port spaced from each other. Each of the inlet, fill, and exhaust ports are fluidly coupled with the chamber. A pumping device is disposed in the housing and fluidly coupled to the inlet port for delivering the fluid through the inlet port into the chamber. A seal member is disposed in the housing and movable between a seated position in which the seal member closes the exhaust port and an unseated position in which the exhaust port is open. A motor is coupled to the housing and has a shaft defining a shaft axis. The shaft is coupled to the pumping device. The motor is capable of rotating the shaft in each of a first rotational direction and a second rotational direction opposite the first rotational direction. A clutch is adjacent to the shaft with the clutch disengaged from the shaft and remaining stationary relative to the shaft as the shaft rotates in the first rotational direction and the clutch engaged with the shaft and rotating with the shaft as the shaft rotates in the second rotational direction. A centrifugal member is disposed about the shaft and mounted to the clutch. The centrifugal member and the clutch rotates as a unit when the shaft rotates in the second rotational direction. The centrifugal member engages the seal member when the shaft rotates in the second rotational direction to move the seal member to the unseated position for permitting the fluid within the chamber to escape through the exhaust port.

Additionally, the subject invention provides for a method of deflating a device utilizing a fluid flow apparatus. The fluid flow apparatus has a housing defining a chamber and further defining an inlet port, a fill port, and an exhaust port. The fluid flow apparatus has a pumping device fluidly coupled to the inlet port and a seal member. The fluid flow apparatus has a motor having a shaft coupled to the pumping device, a clutch, and a centrifugal member mounted to the clutch. The method includes the steps of rotating the shaft of the motor in a rotational direction, activating the pumping device through the rotation of the shaft to move the fluid from the inlet port into the chamber, and simultaneously engaging the clutch with the shaft during the rotation of the shaft. The method also includes the steps of rotating the clutch and the centrifugal member as a unit with the shaft and moving a portion of the centrifugal member toward the seal member. The method further includes the steps of engaging at least a portion of the centrifugal member with the seal member and moving the seal member from the seated position to the unseated position to permit movement of the fluid from the fill port into the chamber and permit movement of the fluid from the chamber through the exhaust port.

Accordingly, the subject invention provides for a fluid flow apparatus having a shaft rotatable in a first rotational direction to inflate a device and rotatable in a second rotational direction to deflate the device.

BRIEF DESCRIPTION OF THE DRAWINGS

Advantages of the subject invention will be readily appreciated as the same becomes better understood by reference to the following detailed description when considered in connection with the accompanying drawings.

DETAILED DESCRIPTION OF THE INVENTION

Figure 1:
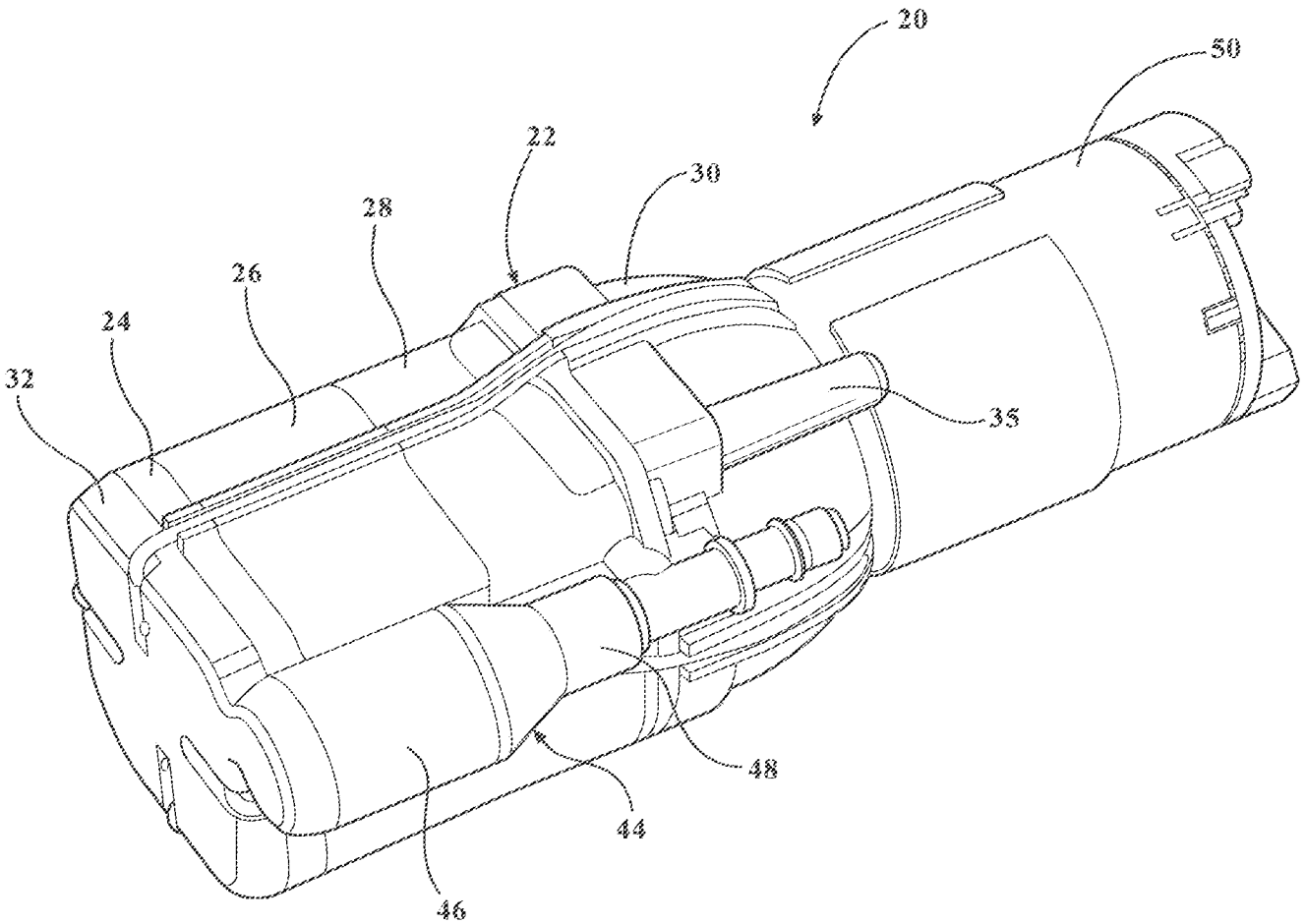
FIG. 1 is a perspective view of a fluid flow apparatus.

Referring to the Figures, wherein like numerals indicate like or corresponding parts throughout the several views, a fluid flow apparatus 20 for transporting a fluid to inflate and deflate a device is generally shown in FIG. 1. The fluid flow apparatus 20 is typically disposed within a vehicle for transporting at least one occupant. The occupant is typically defined as a driver that actively operates the vehicle or a passenger that passively is transported by the operated vehicle. The vehicle is further defined as a passenger car, a truck, or any other configuration for providing transportation. The vehicle includes at least one seat disposed within the vehicle for supporting the occupant(s). The device is typically a bladder disposed within the seat. The fluid flow apparatus 20 inflates and deflates the device to vary the support given through the seat to the occupant. The fluid is typically a gas. However, it is to be appreciated that the fluid can be a liquid or any other configuration transportable to and from the device.

It is to be appreciated that application of the fluid flow apparatus 20 is not limited to within the vehicle. Furthermore, the device is not limited to application within the seat. As such, the fluid flow apparatus 20 can be disposed in any configuration for transporting the fluid to any device.

Figure 2:
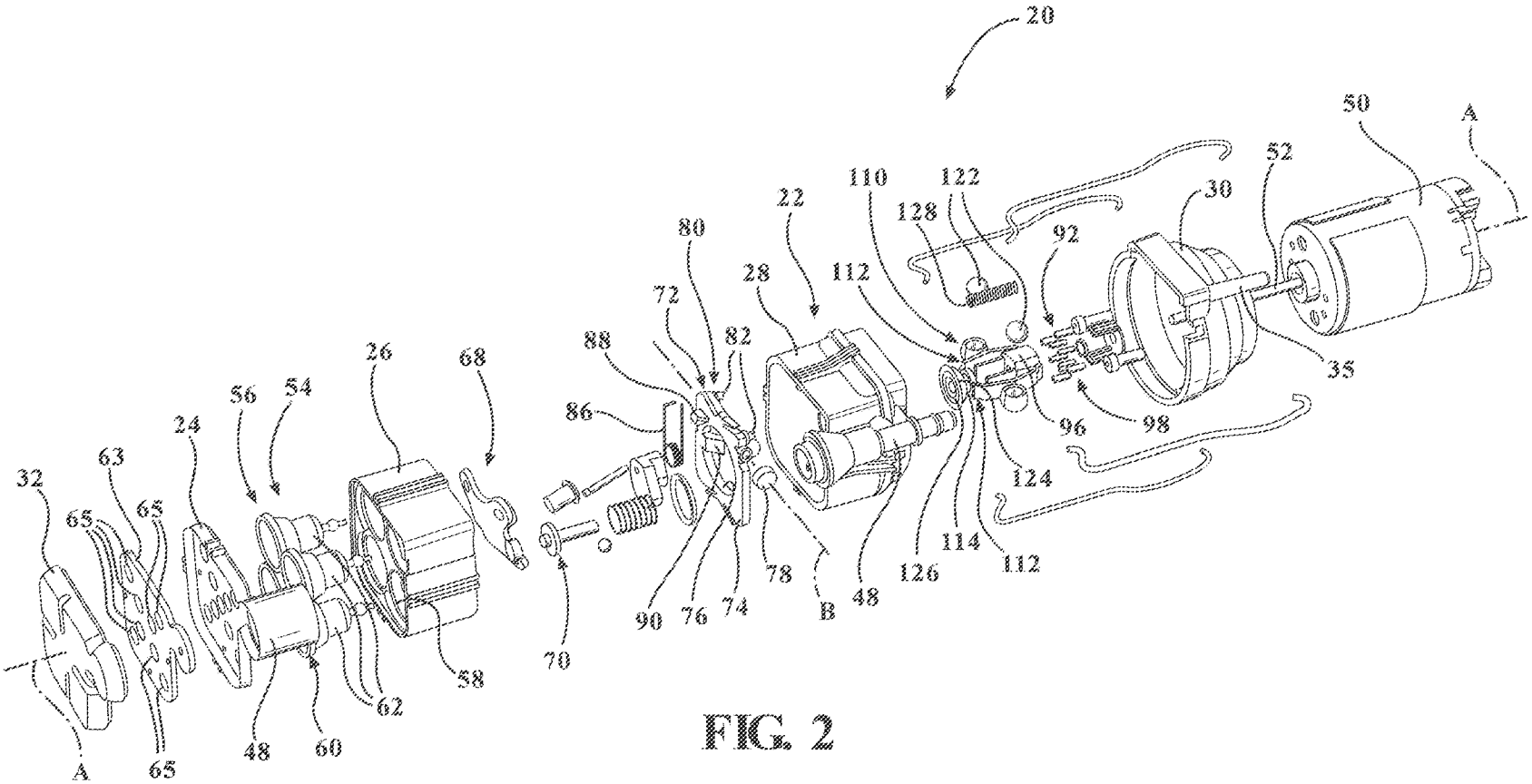
FIG. 2 is an exploded view of the fluid flow apparatus.
Figure 3:
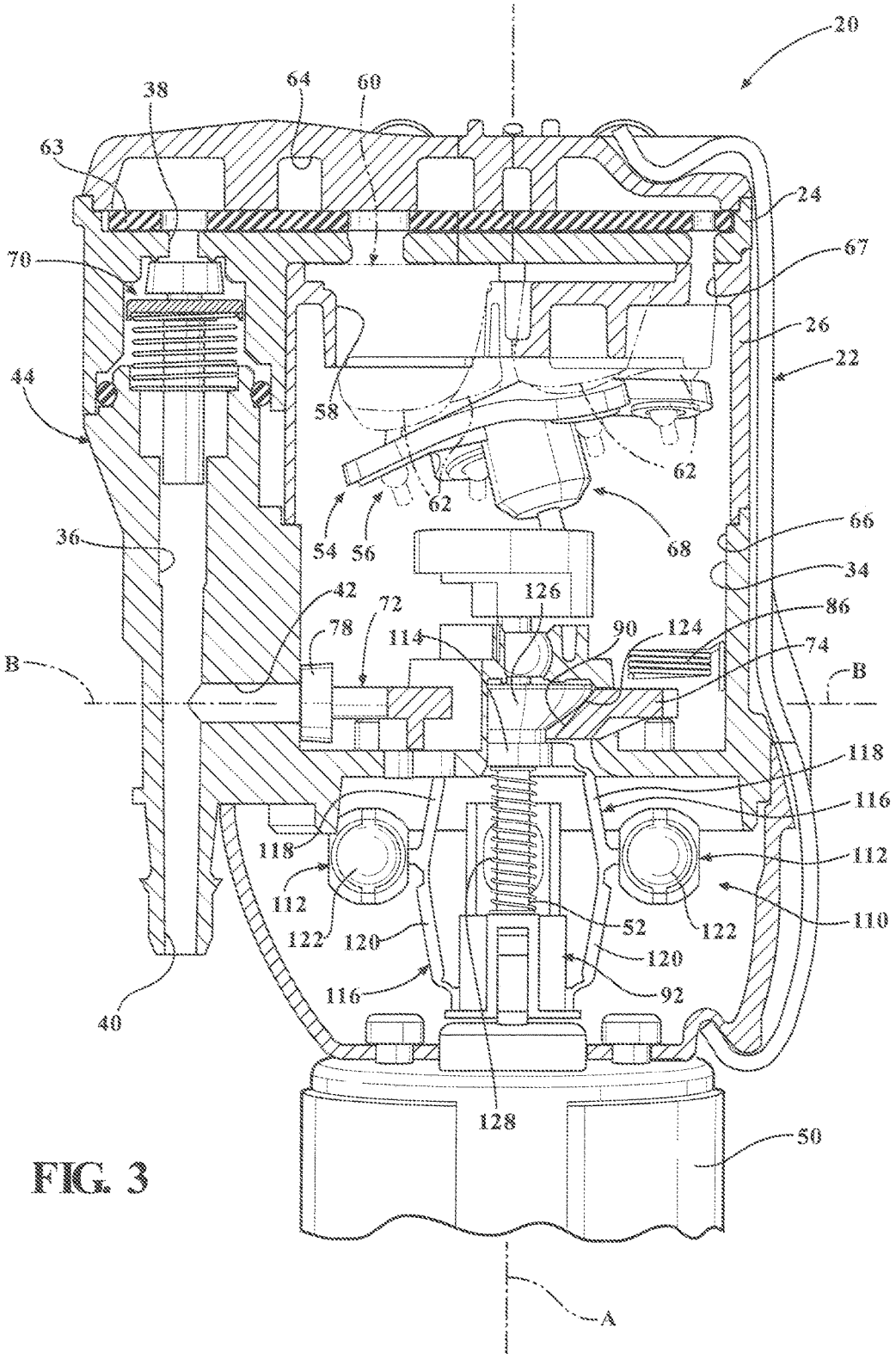
FIG. 3 is a cross-sectional view of the fluid flow apparatus.

As shown in FIGS. 2 and 3, the fluid flow apparatus 20 includes a housing 22. The housing 22 includes a first housing section 24, a second housing section 26, a third housing section 28, and a fourth housing section 30 linearly aligned with one another. More specifically, the first, second, third, and fourth housing sections 24, 26, 28, 30 are sequentially disposed and abut each other. The housing 22 further includes a cover 32 linearly aligned with the first, second, third, and fourth housing sections 24, 26, 28, 30. The cover 32 abuts the first housing section 24 opposite the second housing section 26. Each of the first, second, third, and fourth housing sections 24, 26, 28, 30 and the cover 32 define an interior 34.

Figure 8A:
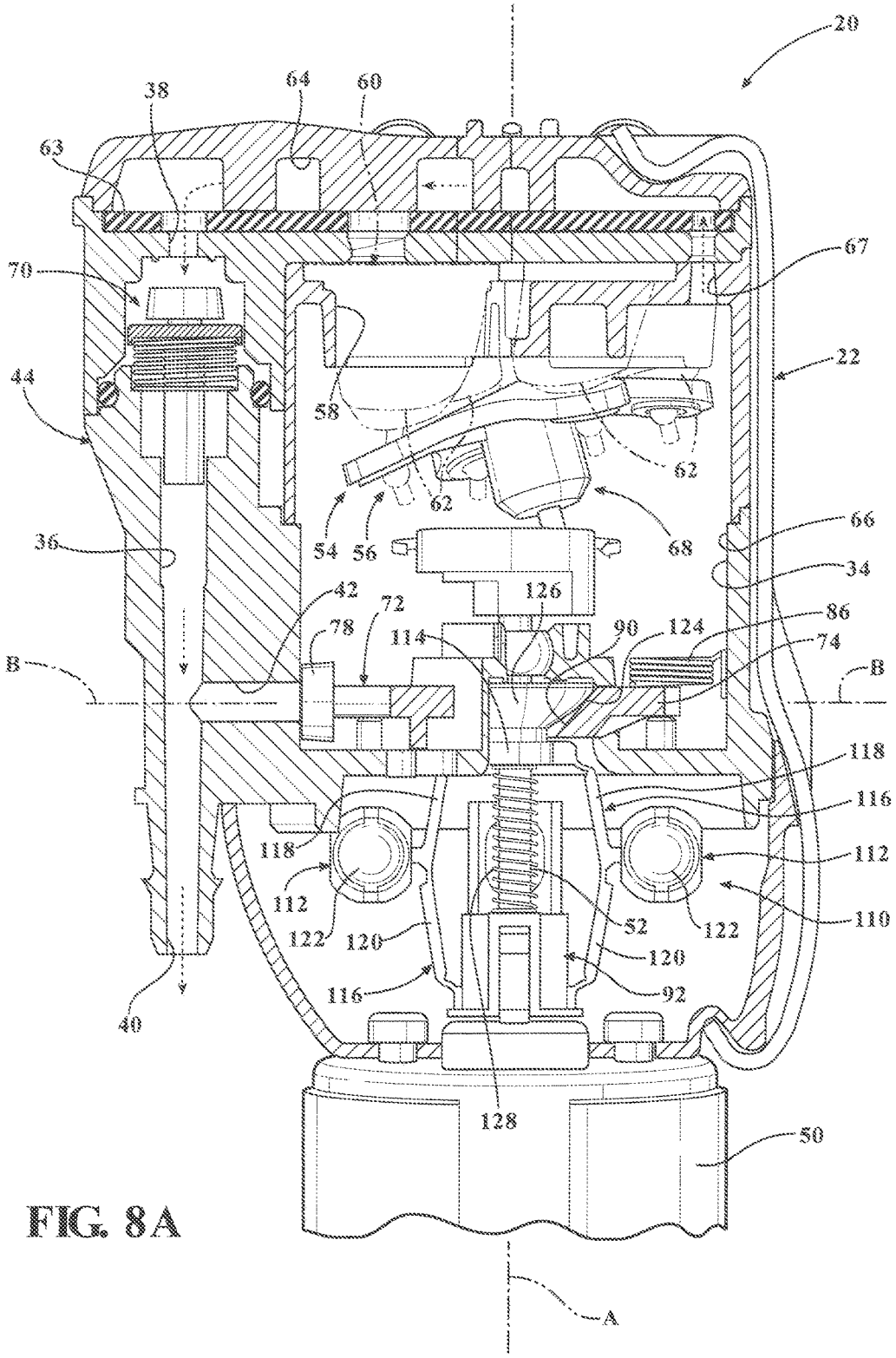
FIG. 8A is a cross-sectional view of the fluid flow apparatus having a shaft and a pump device with the shaft and the pumping device rotating in a first rotational direction and the seal member in the seated position.
Figure 8B:
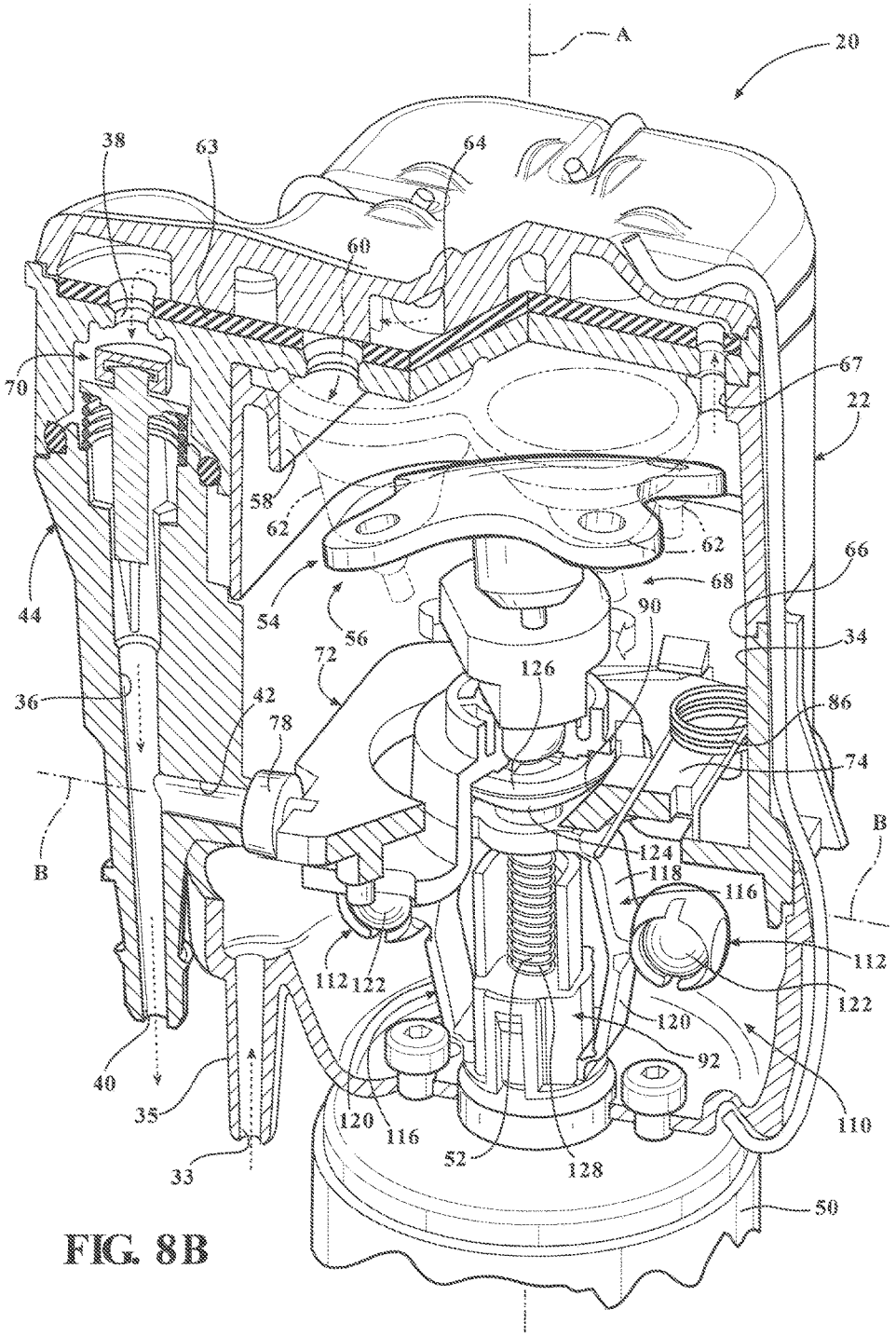
FIG. 8B is a perspective cross-sectional view of the shaft and the pumping device rotating in a first rotational direction and the seal member in the seated position.
Figure 9A:
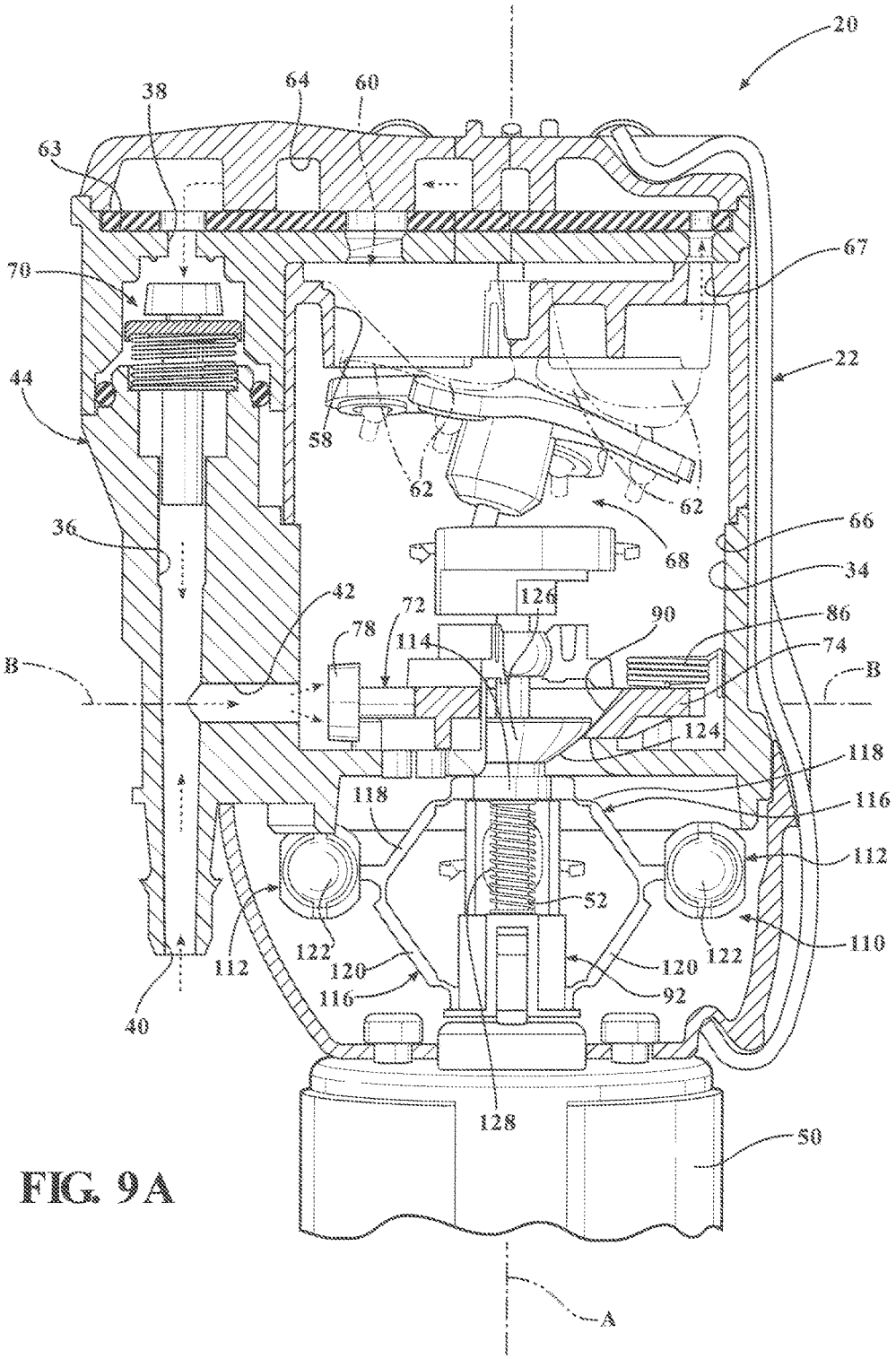
FIG. 9A is a cross-sectional view of the fluid flow apparatus having a centrifugal member, the shaft, and the pump device with the centrifugal member, the shaft, and the pump device rotating in a second rotational direction and the seal member in the unseated position.
Figure 9B:
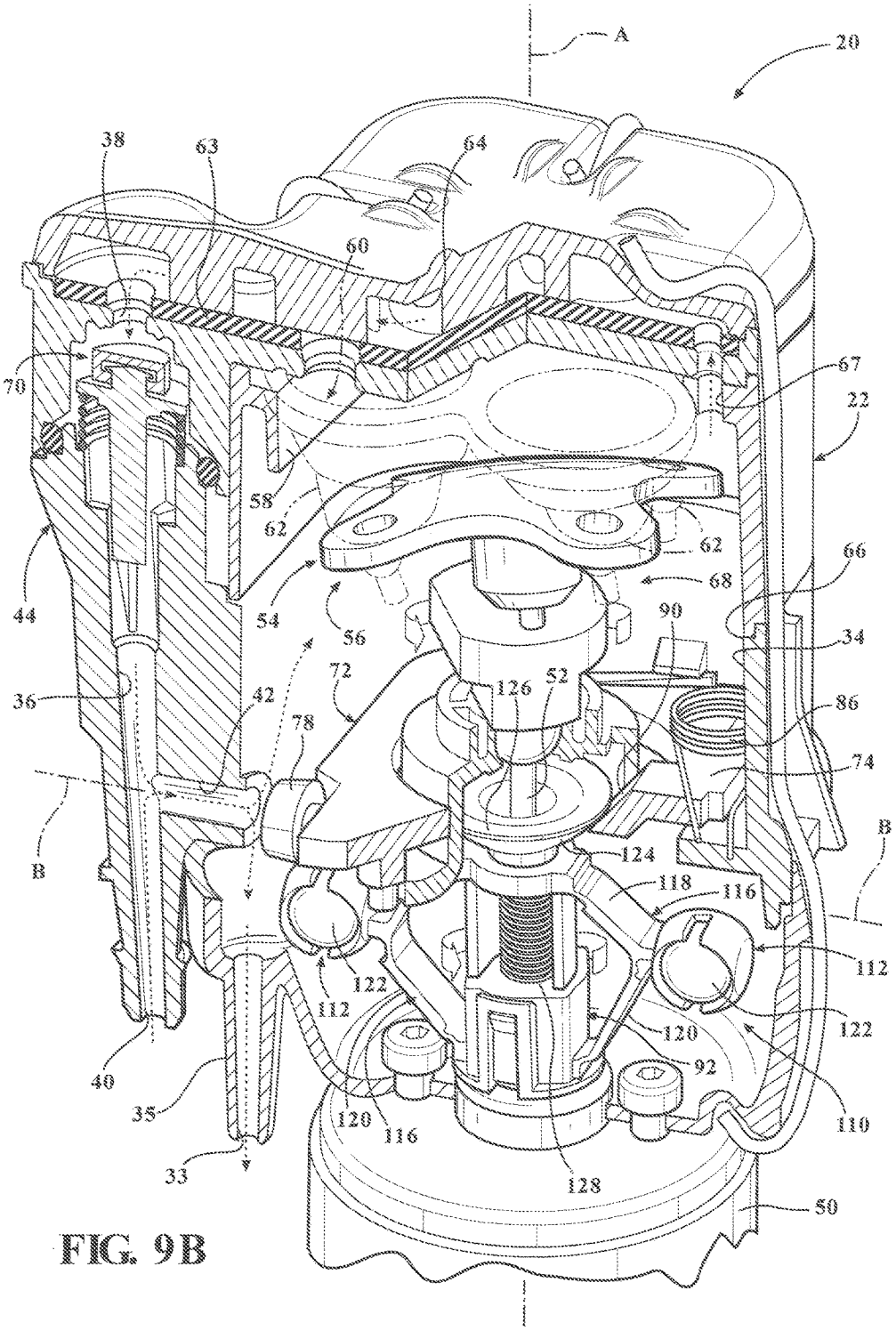
FIG. 9B is a perspective cross-sectional view of the centrifugal member, the shaft, and the pump device rotating in a second rotational direction and the seal member in the unseated position.

As shown in FIGS. 8B and 9B, the housing 22 defines an opening 33 fluidly coupled to the interior 34. More specifically, the fourth housing section 30 has a nozzle 35 extending outwardly with the nozzle 35 defining the opening 33. The opening 33 is capable of passing the fluid out of, and away from, the fluid flow apparatus 20 as well as passing fluid through the opening 33 into the interior 34. A tube, hose, or any other like component can be coupled to the nozzle 35 to further direct the fluid away from the fluid flow apparatus 20.

Figure 4:
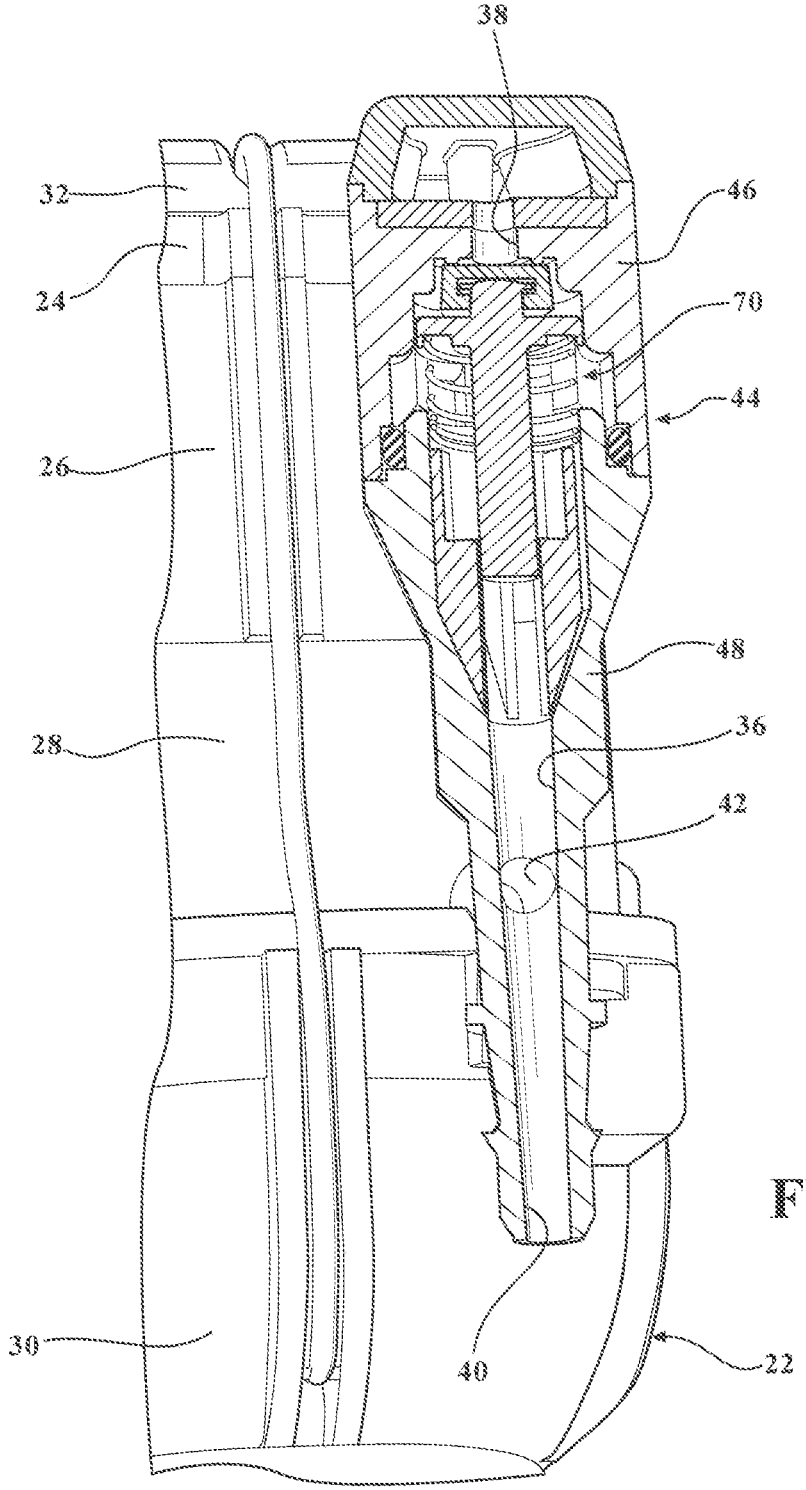
FIG. 4 is a cross-sectional view of a manifold and a check valve of the fluid flow apparatus.

The housing 22 defines a chamber 36, as shown in FIG. 4. The housing 22 further defines an inlet port 38, a fill port 40, and an exhaust port 42 spaced from each other with each of the inlet, fill, and exhaust ports 38, 40, 42 fluidly coupled with the chamber 36. The housing 22 includes a manifold 44 extending outwardly from housing 22. The manifold 44 has a first manifold section 46 and a second manifold section 48 with the first manifold section 46 integral with the first housing section 24 and the second manifold section 48 integral with the third housing section 28. The first manifold section 46 and second manifold section 48 are linearly aligned with one another, such that the first and second manifold sections 46, 48 are sequentially disposed and abut each other. The chamber 36 is at least partially defined within the manifold 44 for transporting the fluid between the inlet, fill, and exhaust ports 38, 40, 42. More specifically, the chamber 36 is at least partially defined by the first and second manifold sections 46, 48 of the manifold 44. Moreover, the inlet port 38 is further defined by the first manifold section 46 while the fill and exhaust ports 40, 42 are defined by the second manifold section 48.

The fluid flow apparatus 20 includes a motor 50 coupled to the housing 22, as shown in FIGS. 2 and 3. More specifically, the motor 50 is coupled to the fourth housing section 30 of the housing 22 opposite the third housing section 28 of the housing 22. The motor 50 has a shaft 52 defining a shaft axis A. The shaft 52 extends from the motor 50 into the interior 34 of the housing 22. Furthermore, the shaft axis A extends longitudinally through housing 22. The motor 50 is capable of rotating the shaft 52 in each of a first rotational direction and a second rotational direction opposite the first rotational direction. More specifically, the motor 50 is capable of rotating the shaft 52 in the first and second rotational directions about the shaft axis A. The motor 50 is typically further defined as an electric motor; however, it is to be appreciated that the motor 50 can be any suitable configuration for rotating the shaft 52 in the first and second rotational directions.

The fluid flow apparatus 20 includes a pumping device 54 disposed in the housing 22 with the shaft 52 coupled to the pumping device 54, as shown in FIG. 3. More specifically, the pumping device 54 is disposed within the interior 34 of the housing 22 at the first, second, and third housing sections 24, 26, 28. The pumping device 54 is fluidly coupled to the inlet port 38 for delivering the fluid through the inlet port 38 into the chamber 36. More specifically, the pump device is further defined as a diaphragm pump 56 coupled to the shaft 52 and fluidly coupled to the inlet port 38. The second housing section 26 defines a plurality of a cavities 58 extending parallel to the shaft axis A. The diaphragm pump 56 further includes a diaphragm 60 disposed between the second housing section 26 and the cover 32 of the housing 22. The diaphragm 60 defines a plurality of cups 62 extending toward the fourth housing section 30 of the housing 22. The diaphragm 60 engages the second housing section 26 and the each of the cups 62 extend into each of the cavities 58 of the second housing section 26. The diaphragm 60 and the second housing section 26 partially define a first interior 64 and a second interior 66 with the first interior 64 defined by the cover 32, the first housing section 24, the second housing section 26, and the diaphragm 60, and with the second interior 66 defined by the second housing section 26, third housing section 28, the fourth housing section 30, and the diaphragm 60.

As shown in FIG. 2, the diaphragm pump 56 includes a valve plate 63 disposed between the diaphragm 60 and the cover 32 with the valve plate 63 abutting the diaphragm 60. The valve plate 63 has a plurality of valves 65 adjacent each of the cups 62. The valves 65 selectively open and close the cups 62 so as to selectively allow the movement of the fluid in the first interior 64 into and out of the cups 62.

The first and second housings 24, 26 and the valve plate 63 define a plurality of apertures 67 extending between the first and second interiors 64, 66 to fluidly couple the first and second interiors 64, 66 to each other, as best illustrated in FIG. 3. Specifically, the diaphragm 60 abuts and seals against the second housing section 26 such that the fluid can only flow between the first and second interiors 64, 66 through the apertures 67.

The diaphragm pump 56 further includes a pivot assembly 68. The pivot assembly 68 is coupled to the shaft 52 and to each of the plurality of cups 62 of the diaphragm 60. The diaphragm pump 56 rotates with the shaft 52 in each of the first and second rotational directions and continually supplies the chamber 36 with the fluid during the rotation of the shaft 52 in each of the first and second rotational directions. Specifically, the pivot assembly 68 rotates with shaft 52 in first and second rotational directions. The pivot assembly 68 repetitiously deforms each of the cups 62 towards and away from the cover 32. The repetitious deformation of the cups 62 draws the fluid disposed outside of the housing 22 into the second interior 66 through the opening 33. The fluid is drawn through the apertures 67 and into the first interior 64. The first interior 64 is fluidly coupled to the inlet port 38. The repetitious deformation of the cups 62 towards and away from the cover 32, in conjunction with the selective opening and closing of the cups 62 by the valves 65 of the valve plate 63, transports the fluid to the inlet port 38, as shown in FIG. 8A through 9B.

The fluid flow apparatus 20 further includes a check valve 70 disposed within the chamber 36 of the housing 22 between the inlet port 38 and each of the fill and exhaust ports 40, 42, as shown in FIG. 4. Specifically, the check valve 70 is disposed in the chamber 36 proximate the inlet port 38. The check valve 70 is movable between a closed position in which the check valve 70 closes the inlet port 38 and seals against the housing 22, and an open position in which the check valve 70 is spaced from the inlet port 38 to open the inlet port 38. The check valve 70 is biased toward the inlet port 38 such that the check valve 70 is normally in the closed position. The diaphragm pump 56 pressurizes the fluid within the first interior 64. When the pressure is sufficient within the first interior 64 to overcome the bias of the check valve 70, the check valve 70 moves from the closed position to the open position allowing the fluid to flow from the first interior 64 into the chamber 36. The check valve 70 allows one-way flow of the fluid from the inlet port 38 to the fill and exhaust ports 40, 42. As stated previously, the check valve 70 is disposed within the chamber 36 and is biased toward the inlet port 38. As such, pressurization of the fluid within the chamber 36 further seals the check valve 70 against the housing 22 to prevent flow of the fluid from the chamber 36, through the inlet port 38, and into the first interior 64.

Figure 5:
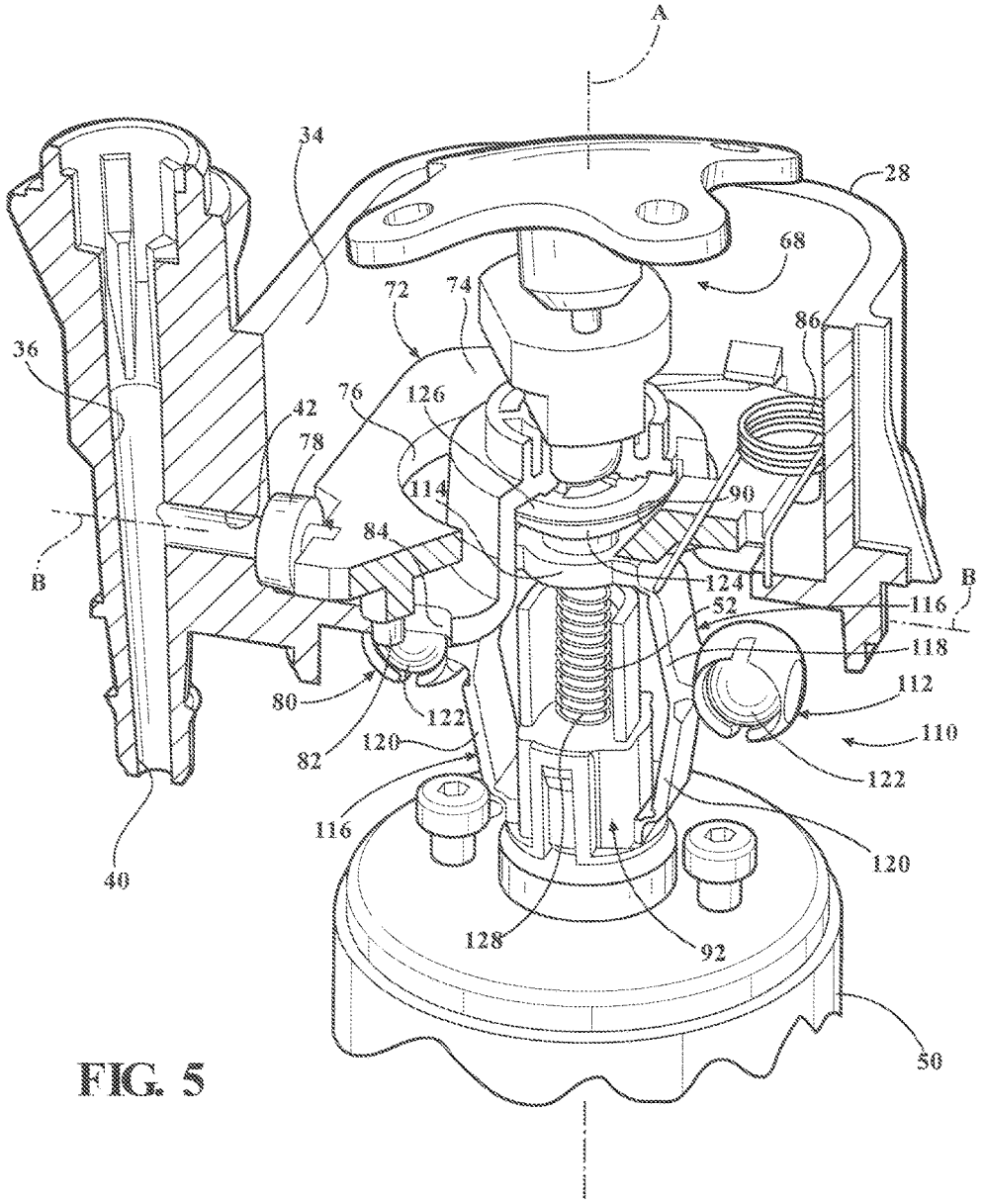
FIG. 5 is a perspective cross-sectional view of a third housing section of the fluid flow apparatus with a seal member in a seated position.
Figure 6:
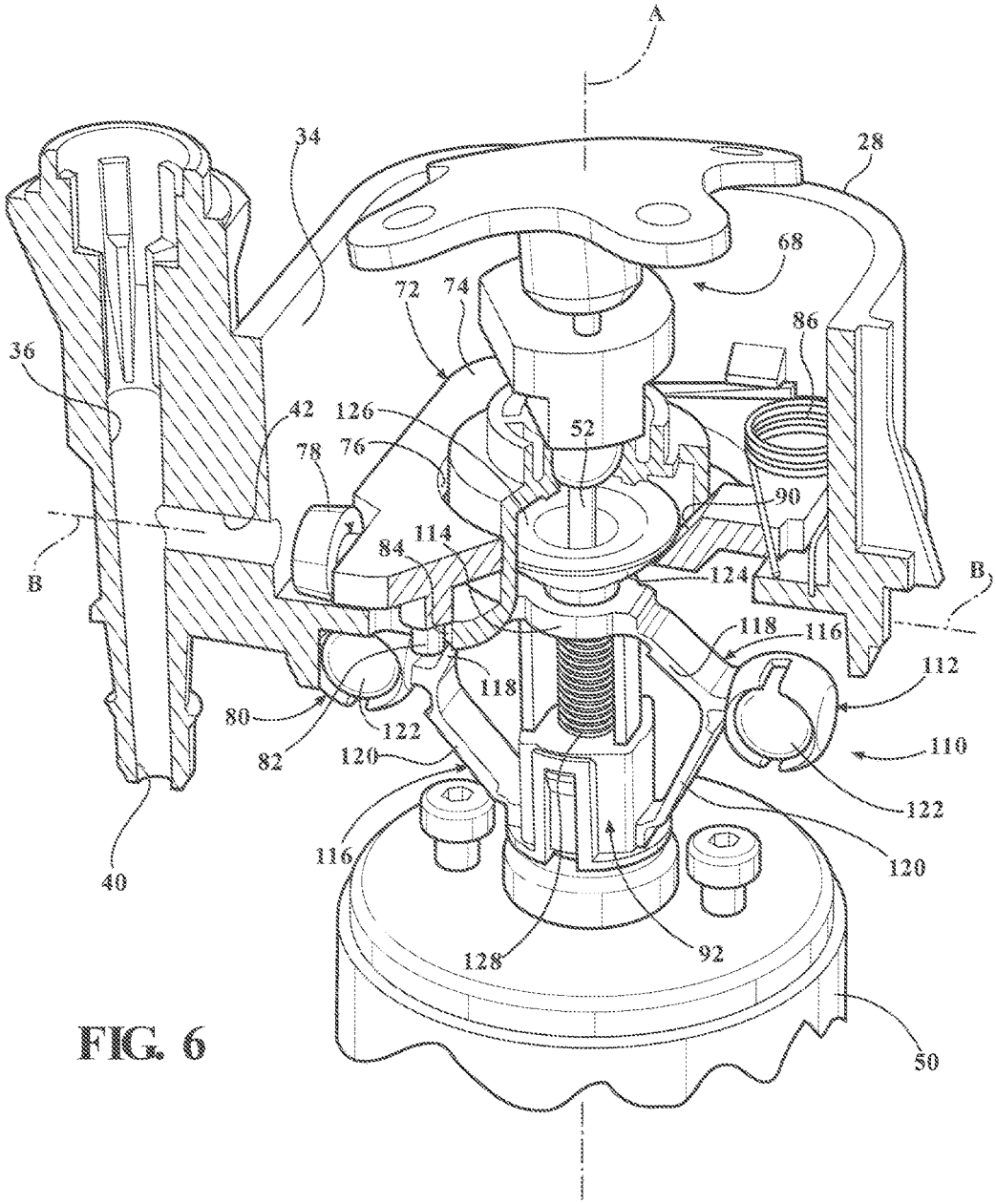
FIG. 6 is a perspective cross-sectional view of the third housing with the seal member in an unseated position.

The fluid flow apparatus 20 includes a seal member 72 disposed in the housing 22, as shown in FIGS. 5 and 6. The seal member 72 has a seal body 74 defining a hole 76 extending substantially parallel to the shaft axis A. The seal body 74 surrounds the shaft 52 such that the shaft 52 extends through the hole 76. The hole 76 is substantially larger than the shaft 52 such that the seal member 72 is capable of moving transverse to the shaft axis A. The seal member 72 is movable between a seated position in which the seal member 72 closes the exhaust port 42, as shown in FIG. 5, and an unseated position in which the exhaust port 42 is open, as shown in FIG. 6. More specifically, the seal member 72 includes a seal tip 78 extending from the seal body 74 toward the exhaust port 42. The seal tip 78 selectively engages the housing 22 adjacent the exhaust port 42. Specifically, the seal tip 78 engages and seals the housing 22 surrounding the exhaust port 42 in the seated position. In the unseated position, the seal tip 78 is spaced from the exhaust port 42.

The seal member 72 moves linearly between the seated and unseated positions. Specifically, the seal member 72 moves transverse to the shaft axis A. More specifically, the exhaust port 42 defines a seal axis B substantially perpendicular to the shaft axis A. The seal member 72 moves linearly along the seal axis B toward and away from the exhaust port 42. It is to be appreciated that the seal member 72 can be configured move in a curvilinear path or a pivotable path, or in any other configuration in which the seal member 72 closes and opens the exhaust port 42.

The seal member 72 includes a guide interface 80 engaging the housing 22 to guide the seal member 72 between the seated position and the unseated position, as shown in FIGS. 5 and 6. As shown in FIG. 2, the seal member 72 includes two guide interfaces 80 spaced from each. It is to be appreciated that the seal member 72 can have any number of guide interfaces 80 for guiding the seal member 72 between the seated position and the unseated position. As shown in FIGS. 5 and 6, the guide interface 80 is further defined as a post 82 with the housing 22 defining a slot 84. More specifically, the third housing section 28 of the housing 22 defines the slot 84 and the seal body 74 of the seal member 72 has the post 82. The slot 84 extends through the third housing section 28 substantially parallel to the shaft axis A. The slot 84 longitudinally extends substantially parallel to the seal axis B. The post 82 extends through and is slidable within the slot 84 to guide the seal member 72 between the seated position and the unseated position. Specifically, the post 82 of the seal member 72 is slidable longitudinally within the slot 84 such that the seal member 72 moves substantially parallel to the seal axis B.

The seal member 72 includes a seal biasing member 86 biasing the seal member 72 toward the seated position for closing the exhaust port 42. The seal body 74 of the seal member 72 has a tab, as shown in FIG. 2, with the seal biasing member 86 engaging both the tab 88 and the housing 22. The seal biasing member 86 moves the seal member 72 toward the exhaust port 42 such that the seal member 72 is normally disposed in the seated position, as shown in FIG. 5. The bias of the seal biasing member 86 is configured such that over pressurization of the fluid within the chamber 36 can move the seal member 72 from the seated position to the unseated position to "bleed" the fluid from the chamber 36. Said differently, the seal biasing member 86 is configured to allow the seal member 72 to move from the seated position to the unseated position, as shown in FIG. 6, as the pressure of the fluid within the chamber 36 reaches a pressure above which damage can occur to either or both of the fluid flow apparatus 20 and the device. The fluid flows through the exhaust port 42 from the chamber 36 into the second interior 66 where a portion of the fluid flows through the apertures 67 into the first interior 64 and a portion of the fluid flows through the opening 33 away from the fluid flow apparatus 20, as shown in FIG. 9B.

As shown in FIG. 3, the seal member 72 has a second engagement surface 90. More specifically, the second engagement surface 90 is disposed on seal body 74 of the seal member 72 proximate the shaft 52. The second engagement surface 90 of the seal member 72 is angled transverse to the shaft axis A. Furthermore, the second engagement surface 90 is angled transverse to the seal axis B. As such, the second engagement surface 90 is angled such that the second engagement surface 90 faces both the shaft 52 and the diaphragm pump 56. The purpose of the second engagement surface 90 will be better understood in the discussion below.

Figure 7:
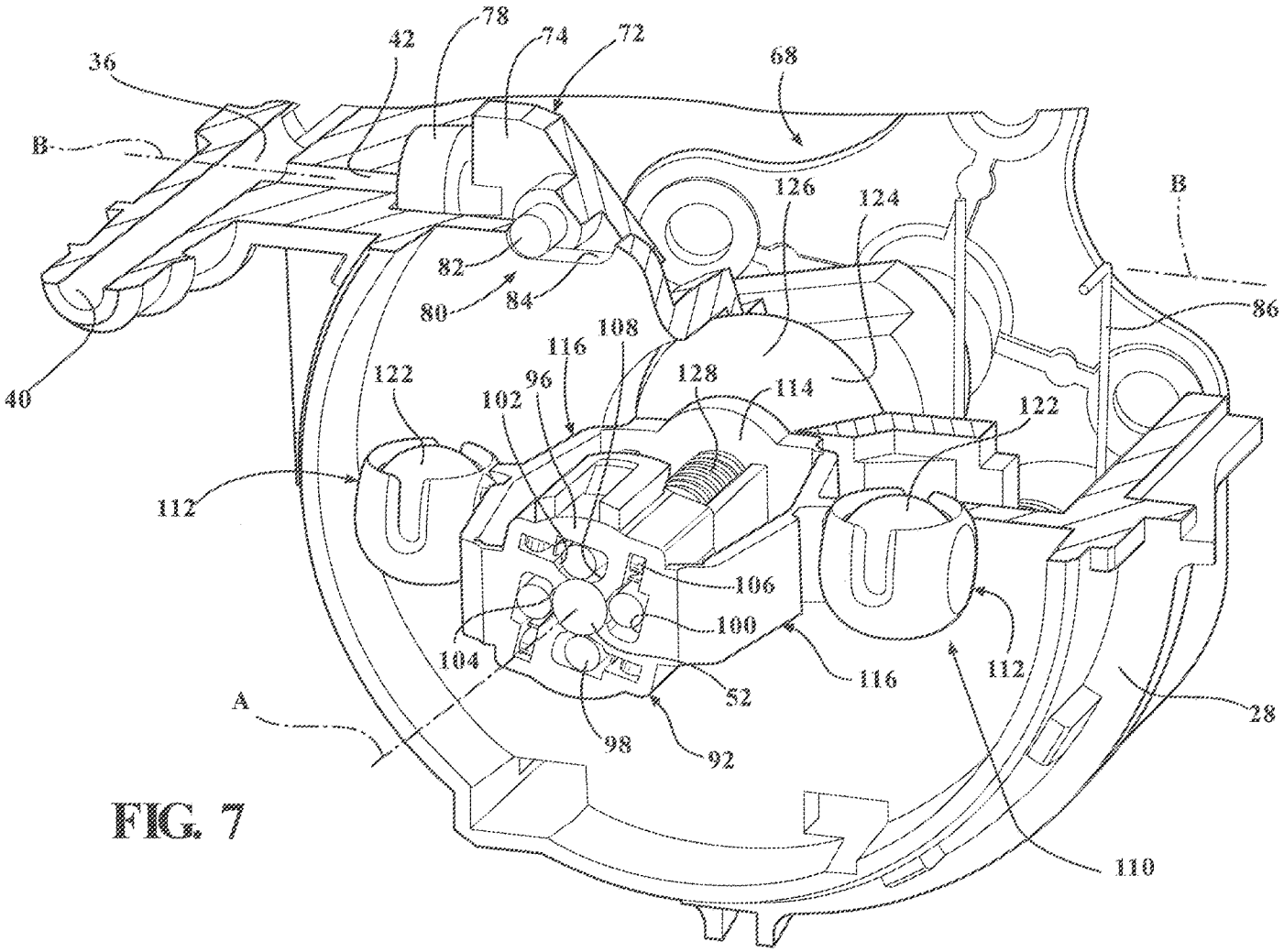
FIG. 7 is a perspective view of a clutch of the fluid flow apparatus.

The fluid flow apparatus 20 includes a clutch 92 adjacent to the shaft 52, as shown in FIG. 7. The clutch 92 surrounds the shaft 52 and is disposed adjacent the motor 50. Said differently, the clutch 92 defines a bore 94 extending longitudinally through the clutch 92 along the shaft axis A with the shaft 52 extending through the bore 94. The clutch 92 is fixed longitudinally along the shaft axis A, such that the clutch 92 does not slide longitudinally along the shaft 52. The clutch 92 is capable of rotating independently from the shaft 52 about the shaft axis A.

The clutch 92 is disengaged from the shaft 52 and remains stationary relative to the shaft 52 as the shaft 52 rotates in the first rotational direction. Conversely, the clutch 92 engages the shaft 52 and rotates with the shaft 52 as the shaft 52 rotates in the second rotational direction.

The clutch 92 includes a clutch housing 96 and at least one roller 98. The clutch housing 96 defines at least one clutch cavity 100 and an engagement wall 102 disposed within the clutch cavity 100. Both the clutch cavity 100 and the roller 98 extend longitudinally along the shaft axis A such that the clutch cavity 100 and the roller 98 are substantially parallel to the shaft axis A. The clutch 92 defines a clutch opening 104 between the bore 94 and the clutch cavity 100 for providing access between the bore 94 and the clutch cavity 100.

The roller 98 is disposed within the clutch cavity 100 adjacent the clutch opening 104. The clutch 92 further includes a clutch bias member 106 disposed within the clutch cavity 100 adjacent the engagement wall 102. The clutch 92 includes a disengagement wall 108 adjacent to the clutch opening 104 and opposite the engagement wall 102. The clutch bias member 106 engages and biases the roller 98 toward the disengagement wall 108.

As shown in FIG. 7, the at least one roller 98 is further defined as four rollers 98 and the at least one clutch cavity 100 is further defined as four clutch cavities 100 spaced from each other about the shaft axis A. It is to be appreciated that the clutch 92 can be configured with any number of roller 98 and any number of clutch cavities 100 without escaping the scope of the subject invention.

The roller 98 rotates within the clutch cavity 100 relative to the shaft 52 as the shaft 52 rotates in the first rotational direction. As such, in the first rotational direction the clutch 92 is disengaged from the shaft 52. Specifically, as the shaft 52 rotates in the first rotational direction, the roller 98 engages the shaft 52 and rotates with the shaft 52. The roller 98 rotates and moves toward the disengagement wall 108. The roller 98 rotates along the disengagement wall 108 which moves the roller 98 away from the shaft 52. Continual rotation of the shaft 52 in the first rotational direction maintains the roller 98 on the disengagement wall 108. The roller 98 freely rotates on the disengagement wall 108 which facilitates the rotation of the shaft 52 in the first rotational direction with the clutch 92 remaining stationary about the shaft axis A. It is to be appreciated that the roller 98 can slide along the shaft 52 as the shaft 52 rotates in the first rotational direction without escaping the scope of the subject invention.

On the other hand, the roller 98 is substantially sandwiched between the shaft 52 and the engagement wall 102 as the shaft 52 rotates in the second rotational direction. Rotation of the shaft 52 in the second rotational direction engages the clutch 92 with the shaft 52. Specifically, as the shaft 52 rotates in the second rotational direction, the roller 98 engages the shaft 52 and rotates with the shaft 52. The roller 98 rotates and moves toward the engagement wall 102 against the bias of the clutch bias member 106. The roller 98 engages engagement wall 102. The engagement wall 102 is transverse to the shaft 52. As such, the roller 98 cannot roll along the engagement wall 102 away from the shaft 52 which sandwiches the roller 98 between engagement wall 102 and shaft 52. Sandwiching the roller 98 between engagement wall 102 and shaft 52 facilitates engagement of the clutch 92 with the shaft 52 such that the clutch 92 rotates with the shaft 52 in the second rotational direction.

In an alternative embodiment, the clutch 92 is further defined as a magnetic clutch. Specifically, the magnetic clutch utilizes a magnetic field to facilitate selective engagement of the magnetic clutch with the shaft 52.

The fluid flow apparatus 20 includes a centrifugal member 110 disposed about the shaft 52 and mounted to the clutch 92, as shown in FIG. 3. Typically, the centrifugal member 110 is integral with the clutch 92; however, it is to be appreciated that the centrifugal member 110 can be any configuration without escaping the scope of the subject invention. The centrifugal member 110 includes at least one pendulum 112. The at least one pendulum 112 is further defined as at least two pendulums 112 evenly spaced about the shaft 52. It is to be appreciated that the pendulums 112 can be any number of pendulums 112 spaced evenly about the shaft 52.

The pendulum 112 is coupled to the clutch 92 at a first end. The centrifugal member 110 includes a body 114 movable longitudinally along the shaft axis A with the pendulum 112 coupled to the body 114 at a second end. The pendulum 112 includes an arm 116 coupled to each of the clutch 92 and the body 114. The arm 116 has a first section 118 coupled to the body 114 and a second section 120 coupled to the clutch 92. The pendulum 112 includes a weight 122 disposed between the first and second sections 118, 120.

The centrifugal member 110 has a first engagement surface 124. Furthermore, the centrifugal member 110 includes an engagement portion 126. The engagement portion 126 is disposed along the shaft axis A adjacent to the body 114 opposite the pendulum 112. The engagement portion 126 has a substantially conical configuration. The engagement portion 126 further defines the first engagement surface 124. The first engagement surface 124 of the centrifugal member 110 is angled transverse to the shaft axis A with the first and second engagement surface 90 substantially parallel to each other. As such, the first engagement surface 124 is angled such that the first engagement surface 124 faces the fourth housing section 30 of the housing 22.

The centrifugal member 110 includes a body biasing member 128 disposed between the clutch 92 and the body 114. More specifically, the body biasing member 128 surrounds and extends along the shaft 52 between the clutch 92 and the body 114. The body biasing member 128 biases the body 114 away from the clutch 92.

As discussed above, the roller 98 of the clutch 92 is substantially sandwiched between the shaft 52 and the engagement wall 102 of the clutch 92 as the shaft 52 rotates in the second rotational direction to engage the clutch 92 with the shaft 52 which rotates the centrifugal member 110 with the shaft 52, as shown in FIG. 9. The centrifugal member 110 and the clutch 92 rotate as a unit when the shaft 52 rotates in the second rotational direction.

As discussed above, the at least one pendulum 112 is further defined as at least two pendulums 112 evenly spaced about the shaft 52. The at least two pendulums 112 balance the centrifugal member 110 rotating with the shaft 52 in the second rotational direction about the shaft axis A. The pendulum 112 moves transverse to and away from the shaft axis A as the shaft 52 and the centrifugal member 110 rotate in the second rotational direction. More specifically, the arm 116 of the pendulum 112 deflects away from the shaft axis A and moves the body 114 toward the clutch 92 as the centrifugal member 110 rotates with the shaft 52 in the second rotational direction. Said differently, each of the pendulums 112 have a mass defined by both the weight 122 and the arm 116. The weight 122 provides a greater percentage of the mass to pendulum 112 than the arm 116. When rotated the mass of the pendulum 112 facilitates movement of the pendulum 112 outwardly away for the shaft axis A, about which the pendulum 112 is rotating, due to centrifugal force. The weight 122 moves transverse to and away from the shaft axis A and the first and second sections 118, 120 of the arm 116 pivot about the weight 122 as the centrifugal member 110 rotates with the shaft 52 in the second rotational direction. More specifically, the first and second sections 118, 120 pivot toward each other.

The transverse movement of the pendulum 112 facilitates engagement of the centrifugal member 110 with the seal member 72 to move the seal member 72 from the seated position to the unseated position. Specifically, the pivoting of the first and second sections 118, 120 of the arm 116 toward each other facilitates movement of the body 114 along the shaft axis A toward the clutch 92 as the pendulum 112 moves transverse to and away from the shaft axis A.

The engagement portion 126 of the centrifugal member 110 engages the seal member 72 to move the seal member 72 from the seated position to the unseated position, as shown in FIGS. 6 and 9. The first engagement surface 124 of the engagement portion 126 moves along the shaft axis A between a first position when the shaft 52 rotates in the first rotational direction and a second position when the shaft 52 rotates in the second rotational direction. More specifically, the first engagement surface 124 moves toward the clutch 92 as the first engagement surface 124 moves from the first position to the second position. The first engagement surface 124 engages the second engagement surface 90 of the seal member 72 in the second position.

The first engagement surface 124 engages and slides along the second engagement surface 90 as the first engagement surface 124 moves from the first position to the second position to move the seal member 72 transverse to the shaft axis A from the seated position to the unseated position. Specifically, the angular configuration of the first and second engagement surfaces 124, 90 facilitates the longitudinal movement of the first engagement surface 124 along the shaft axis A and the coinciding movement of the second engagement surface 90 transverse to the shaft axis A as the first engagement surface 124 moves from the first position to the second position.

The body biasing member 128 biases the body 114 away from the clutch 92 as the shaft 52 rotates in the first rotational direction and to facilitate movement of the seal member 72 from the unseated position to the seated position. Specifically, when the shaft 52 rotates in the first rotational direction, the centrifugal member 110 does not rotate with the shaft 52. As such, the centrifugal force does not act on the pendulum 112. In turn, the pendulum 112 does not facilitate movement of the body 114 along the shaft axis A toward the clutch 92. As a result, the first engagement surface 124 does not engage and slide along the second engagement surface 90, which facilitates the movement of the seal member 72 from the unseated position to the seated position by the bias of the seal biasing member 86.

The operation of the fluid flow apparatus 20 will be discussed below for illustrative purposes only. Specifically, the operation of the fluid flow apparatus 20 inflating the device will be discussed first below, followed by the operation of the fluid flow apparatus 20 deflating the device. As generally shown in FIGS. 8A and 8B, the motor 50 rotates the shaft 52 in the first rotational direction. The diaphragm pump 56 rotates with the shaft 52 in the first direction. The rotation of the diaphragm pump 56 causes the fluid to be drawn through the opening 33 into the second interior 66, through the apertures 67, and into the first interior 64, where the fluid becomes pressurized, as specifically shown in FIG. 8B. The pressurization of the fluid overcomes the bias of the check valve 70, facilitating flow of the fluid from the first interior 64, through the inlet port 38, and into the chamber 36. The bias of the seal biasing member 86 of the seal member 72 maintains the seal member 72 in the seated position in which the seal member 72 covers the exhaust port 42. With the exhaust port 42 covered, the fluid has to flow from the chamber 36, through the fill port 40, and into the device to inflate the device.

To deflate the device, the motor 50 rotates the shaft 52 in the second rotational direction, as shown in FIGS. 9A and 9B. The rotation of the diaphragm pump 56 causes the fluid to pressurize in the first interior 64. The pressurization of the fluid overcomes the bias of the check valve 70, facilitating flow of the fluid from the first interior 64, through the inlet port 38, and into the chamber 36.

Concurrent with the pumping of the diaphragm pump 56, the clutch 92 engages the shaft 52. As such, the centrifugal member 110 rotates with the shaft 52 in the second rotational direction. The centrifugal member 110 engages the seal member 72 when the shaft 52 rotates in the second rotational direction to move the seal member 72 to the unseated position for permitting the fluid within the chamber 36 to escape through the exhaust port 42. Specifically, the pendulums 112 move the body 114 and the engagement portion 126 toward the clutch 92. The first engagement surface 124 of the engagement portion 126 engages and slides along the second engagement surface 90 of the seal member 72, facilitating movement of the seal member 72 from the seated position to the unseated position against the bias of seal biasing member 86. In the unseated position, the seal biasing member 86 is spaced away from the exhaust port 42 such that the exhaust port 42 is uncovered. With the exhaust port 42 uncovered, the fluid flows through the exhaust port 42. Specifically, the flows from the diaphragm pump 56 through the inlet port 38 into the chamber 36 and then through the exhaust port 42. Fluid concurrently flows from the device through the fill port 40 into the chamber 36 and then through the exhaust port 42, deflating the device. The convergent fluid from the diaphragm pump 56 and the device flows through the exhaust port 42 into the second interior 66. A portion of the fluid is re-circulated and flows through the apertures 67 into the first interior 64 and a portion of the fluid flows through the opening 33 away from and out of the fluid flow apparatus 20, as shown in FIG. 9B.

When it is desired to stop deflating the device, the motor 50 stops rotating the shaft 52 in the second rotational direction. The seal biasing member 86 biases the seal member 72 toward the seated position for closing the exhaust port 42 when the shaft 52 stops rotating in the second rotational direction. With the seal member 72 in the seated position, the fluid cannot flow from the device to the atmosphere.

The subject invention also discloses a method of deflating the device utilizing the fluid flow apparatus 20. As shown in FIG. 3, the fluid flow apparatus 20 has the housing 22 defining the chamber 36 and further defining the inlet port 38, the fill port 40, and the exhaust port 42. The fluid flow apparatus 20 has the diaphragm pump 56 fluidly coupled to the inlet port 38. The fluid flow apparatus 20 has the seal member 72. Furthermore, the fluid flow apparatus 20 has the motor 50 having the shaft 52 coupled to the diaphragm pump 56. Additionally, the fluid flow apparatus 20 has the clutch 92 and the centrifugal member 110 mounted to the clutch 92.

The method includes the steps of rotating the shaft 52 of the motor 50 in a rotational direction, activating the diaphragm pump 56 through the rotation of the shaft 52 to move the fluid from the inlet port 38 into the chamber 36, and simultaneously engaging the clutch 92 with the shaft 52 during the rotation of the shaft 52, as shown in FIGS. 9A and 9B. It is to be appreciated that the rotational direction is equivalent to the second rotational direction described above. The method also includes the steps of rotating the clutch 92 and the centrifugal member 110 as a unit with the shaft 52 and moving a portion of the centrifugal member 110 toward the seal member 72. It is to be appreciated that the portion of the centrifugal member 110 is equivalent to the engagement portion 126 as described above. The method further includes the steps of engaging at least a portion of the centrifugal member 110 (which is equivalent to the first engagement surface 124 as described above) with the seal member 72 and moving the seal member 72 from the seated position to the unseated position to permit movement of the fluid from the fill port 40 into the chamber 36 and permit movement of the fluid from the chamber 36 through the exhaust port 42.

The invention has been described in an illustrative manner, and it is to be understood that the terminology which has been used is intended to be in the nature of words of description rather than of limitation. As is now apparent to those skilled in the art, many modifications and variations of the subject invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. A fluid flow apparatus for transporting a fluid to inflate and deflate a device, said fluid flow apparatus comprising:
- a housing defining a chamber and further defining an inlet port, a fill port, and an exhaust port spaced from each other with each of said inlet, fill, and exhaust ports fluidly coupled with said chamber;
- a pumping device disposed in said housing and fluidly coupled to said inlet port for delivering the fluid through said inlet port into said chamber;
- a seal member disposed in said housing and movable between a seated position in which said seal member closes said exhaust port and an unseated position in which said exhaust port is open;
- a motor coupled to said housing and having a shaft defining a shaft axis and coupled to said pumping device with said motor capable of rotating said shaft in each of a first rotational direction and a second rotational direction opposite said first rotational direction;
- a clutch adjacent to said shaft with said clutch disengaged from said shaft and remaining stationary relative to said shaft through the entirety of the rotation of said shaft in said first rotational direction and said clutch engaged with said shaft and rotating with said shaft through the entirety of the rotation of said shaft in said second rotational direction; and
- a centrifugal member disposed about said shaft and mounted to said clutch with said centrifugal member and said clutch continuously rotating as a unit with said shaft when said shaft rotates in said second rotational direction, said centrifugal member engaging said seal member when said centrifugal member rotates with said shaft in said second rotational direction to move said seal member to said unseated position for permitting the fluid within said chamber to escape through said exhaust port.

2. A fluid flow apparatus as set forth in claim 1 wherein said centrifugal member includes at least one pendulum with said pendulum moving transverse to and away from said shaft axis as said shaft and said centrifugal member rotates in said second rotational direction, with said transverse movement of said pendulum facilitating engagement of said centrifugal member with said seal member to move said seal member from said seated position to said unseated position.

3. A fluid flow apparatus as set forth in claim 2 wherein said at least one pendulum is further defined as at least two pendulums evenly spaced about said shaft to balance said centrifugal member rotating with said shaft in said second rotational direction about said shaft axis.

4. A fluid flow apparatus as set forth in claim 2 wherein said clutch is fixed longitudinally along said shaft axis with said pendulum coupled to said clutch at a first end, and wherein said centrifugal member includes a body movable longitudinally along said shaft axis with said pendulum coupled to said body at a second end, said body moving along said shaft axis toward said clutch as said pendulum moves transverse to and away from said shaft axis.

5. A fluid flow apparatus as set forth in claim 4 wherein said centrifugal member includes an engagement portion adjacent to said body with said engagement portion engaging said seal member to move said seal member from said seated position to said unseated position.

6. A fluid flow apparatus as set forth in claim 4 wherein said pendulum includes an arm coupled to each of said clutch and said body with said arm deflecting away from said shaft axis and moving said body toward said clutch as said centrifugal member rotates with said shaft in said second rotational direction.

7. A fluid flow apparatus as set forth in claim 6 wherein said arm has a first section coupled to said body and a second section coupled to said clutch, and wherein said pendulum includes a weight disposed between said first and second sections, said weight moving transverse to and away from said shaft axis and said first and second sections pivoting about the weight as said centrifugal member rotates with said shaft in said second rotational direction.

8. A fluid flow apparatus as set forth in claim 4 wherein said centrifugal member includes a body biasing member disposed between said clutch and said body with said body biasing member biasing said body away from said clutch as said shaft rotates in said first rotational direction and to facilitate movement of said seal member from said unseated position to said seated position.

9. A fluid flow apparatus as set forth in claim 1 wherein said centrifugal member has a first engagement surface and said seal member has a second engagement surface with said first engagement surface moving along said shaft axis between a first position when said shaft rotates in said first rotational direction and a second position when said shaft rotates in said second rotational direction with said first engagement surface engaging said second engagement surface of said seal member in said second position.

10. A fluid flow apparatus as set forth in claim 9 wherein said first engagement surface of said centrifugal member and said second engagement surface of said seal member are angled transverse to said shaft axis with said first and second engagement surface substantially parallel to each other, said first engagement surface engaging and sliding along said second engagement surface as said first engagement surface moves from said first position to said second position to move said seal member transverse to said shaft axis from said seated position to said unseated position.

11. A fluid flow apparatus as set forth in claim 9 wherein said centrifugal member includes an engagement portion with said engagement portion further defining said first engagement surface for engaging said second engagement surface of said seal member in said second position.

12. A fluid flow apparatus as set forth in claim 1 wherein said seal member includes a guide interface engaging said housing to guide said seal member between said seated position and said unseated position.

13. A fluid flow apparatus as set forth in claim 1 wherein said guide interface is further defined as a post with said housing defining a slot, said post extending through and slidable within said slot to guide said seal member between said seated position and said unseated position.

14. A fluid flow apparatus as set forth in claim 1 wherein said clutch includes a clutch housing and at least one roller, with said clutch housing defining at least one clutch cavity and an engagement wall disposed within said clutch cavity and said roller disposed within said clutch cavity with said roller rotating within said clutch cavity relative to said shaft as said shaft rotates in said first rotational direction and said clutch disengaged from said shaft, said roller substantially sandwiched between said shaft and said engagement wall as said shaft rotates in said second rotational direction to engage said clutch with said shaft for rotating said centrifugal member with said shaft.

15. A fluid flow apparatus as set forth in claim 1 wherein said seal member includes a seal biasing member biasing said seal member toward said seated position for closing said exhaust port when said shaft stops rotating in said second rotational direction.

16. A fluid flow apparatus as set forth in claim 1 wherein said pumping device is further defined as a diaphragm pump coupled to said shaft and fluidly coupled to said inlet port with said pumping device rotating with said shaft in each of said first and second rotational directions and continually supplying said chamber with the fluid during said rotation of said shaft in each of said first and second rotational directions.

17. A fluid flow apparatus as set forth in claim 1 wherein said housing includes a manifold extending outwardly from housing with said chamber at least partially defined within said manifold for transporting the fluid between said inlet, fill, and exhaust ports.

18. A fluid flow apparatus as set forth in claim 1 further including a check valve disposed within said chamber of said housing between said inlet port and each of said fill and exhaust ports for allowing one-way flow of the fluid from said inlet port to said fill and exhaust ports.

19. A method of inflating and deflating a device utilizing a fluid flow apparatus including a housing defining a chamber and further defining an inlet port, a fill port, and an exhaust port, a pumping device fluidly coupled to the inlet port, a seal member, a motor having a shaft coupled to the pumping device, a clutch, and a centrifugal member mounted to the clutch; said method comprising the steps of:

rotating the shaft of the motor in a first rotational direction or a second rotational direction opposite the first rotational direction;

activating the pumping device through the rotation of the shaft to move the fluid from the inlet port, as defined by the housing, into the chamber;

disengaging the clutch from the shaft and the clutch remaining stationary relative to the shaft through the entirety of the rotation of the shaft in the first rotational direction;

engaging the clutch with the shaft during the entire rotation of the shaft in the second rotational direction;

continuously rotating the clutch and the centrifugal member as a unit with the shaft rotating in the second rotational direction;

engaging the centrifugal member with the seal member as the centrifugal member rotates with the shaft in the second rotational direction; and moving the seal member from the seated position to the unseated position as the centrifugal member rotates with the shaft in the second rotational direction to permit movement of the fluid from the fill port into the chamber and permit movement of the fluid from the chamber through the exhaust port.

* * * * *